United States Patent [19]

Ernst

[11] Patent Number: 4,537,062

[45] Date of Patent: Aug. 27, 1985

[54] METHOD AND APPARATUS FOR INVESTIGATING THE STRUCTURE AND POROSITY OF EARTH AND STONY REGIONS

[75] Inventor: Werner Ernst, Tübingen, Fed. Rep. of Germany

[73] Assignee: Kohlensaure-Werke Rudolf Buse Sohn GmbH & Co., Bad Honningen, Fed. Rep. of Germany

[21] Appl. No.: 543,434

[22] Filed: Oct. 19, 1983

[30] Foreign Application Priority Data

Oct. 19, 1982 [EP] European Pat. Off. ..... 82109653.4

[51] Int. Cl.[3] ..... G01N 15/08

[52] U.S. Cl. ..... 73/38; 436/28

[58] Field of Search ..... 73/38, 37, 40.7; 436/25, 27, 28, 5

[56] References Cited

U.S. PATENT DOCUMENTS

| | | | |
|---|---|---|---|
| 2,318,689 | 5/1943 | Hodell et al. | 436/28 X |
| 2,414,913 | 1/1947 | Williams | 73/38 X |
| 3,106,089 | 10/1963 | Scott et al. | 73/40.7 X |
| 3,690,167 | 9/1972 | Chase, Jr. et al. | 436/27 X |
| 3,889,521 | 6/1975 | Jakimowicz | 73/38 |
| 4,052,885 | 10/1977 | Shuck | 73/38 |

*Primary Examiner*—Stewart J. Levy
*Assistant Examiner*—Joseph W. Roskos
*Attorney, Agent, or Firm*—Laurence R. Brown

[57] ABSTRACT

This invention provides an understanding of the structure and porosity of soil and stony regions. The method is characterized by release of a measuring gas in the region being investigated and its penetration through the investigated region to several places where it is captured and measured. Thus, the measured data from the various measuring locations provides the structure and the porosity of the region being investigated. The method is especially suited for the investigation of dams and the location of underground cavities and tectonic faults.

6 Claims, 8 Drawing Figures

FIG. 1
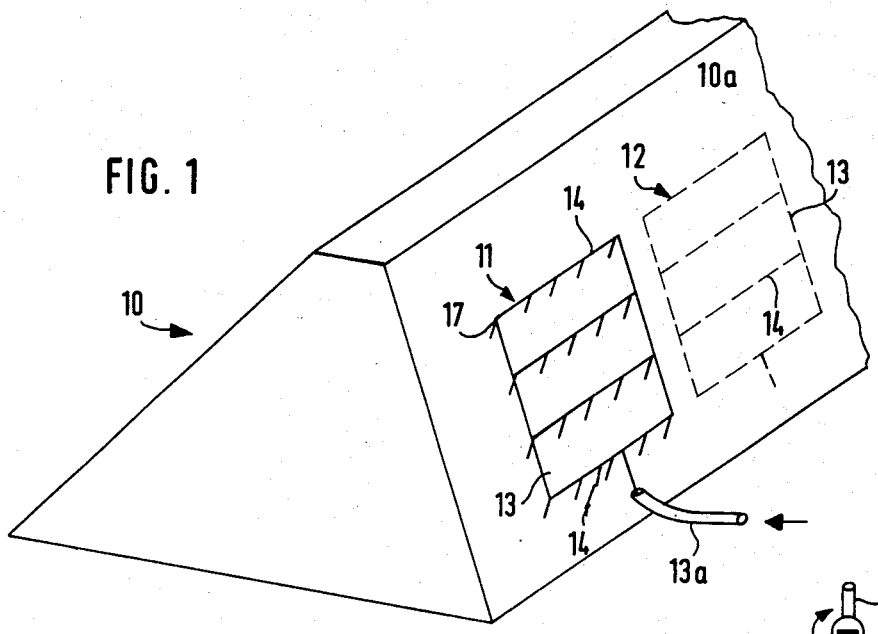
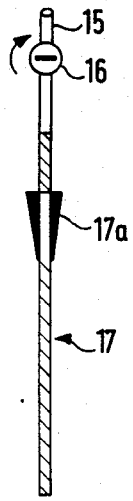
FIG. 1A
FIG. 2
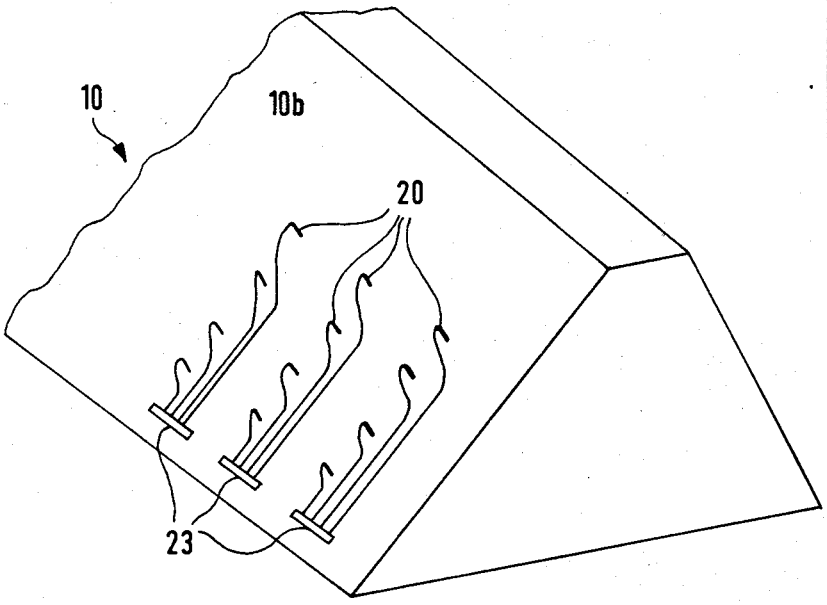

FIG. 3A
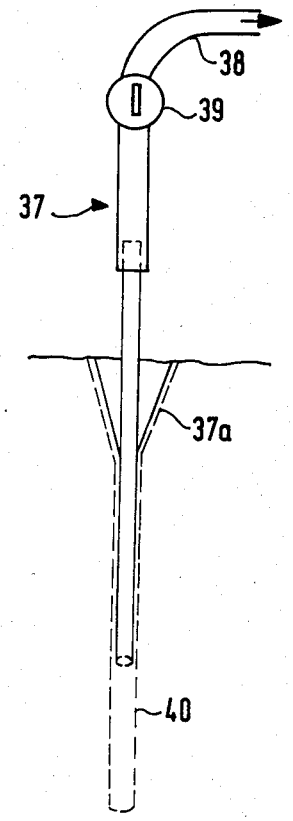
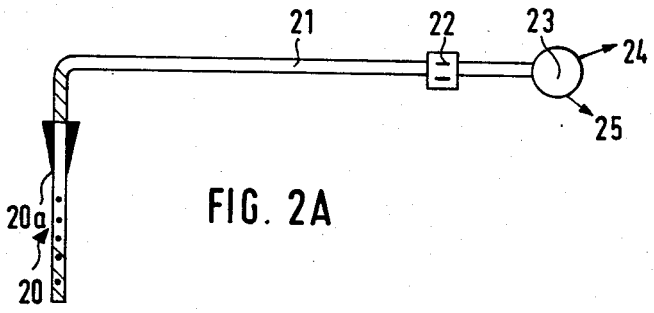
FIG. 2A
FIG. 2B
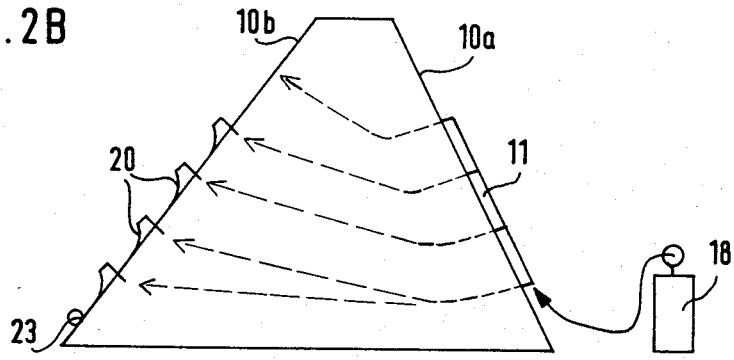

METHOD AND APPARATUS FOR INVESTIGATING THE STRUCTURE AND POROSITY OF EARTH AND STONY REGIONS

TECHNICAL FIELD

This invention relates to the investigation of the structure and porosity of earth and stony regions and presents methods and apparatus for the accomplishment of such investigation.

BACKGROUND ART

Through a study of the horizontal spread of earth gases in controlled digging, it is known that the length of the spreading zone into the dug trench axis depends upon the porosity and dampness of the soil or other earth strata. Furthermore, it is known from DE-OS No. 2705584 that the surface directed expansion of gas under pressure depend upon the thickness and dampness of the soil. This knowledge is also used for the methods of determining the thickness of underground oil deposits.

It is a problem of the following invention to provide methods and equipment based upon the diffusion of gas through the earth and stone, which can make it possible to investigate the structure and porosity in earth and stony regions for the purpose of protecting natural or constructed dams from percolation and reduction of strength, controlling and preventing washouts due to local strata formations, locating underground cavities, to recognize tectonic stratification, other underground deposits and stratification embankments, all in a reliable and harmless way.

DISCLOSURE OF THE INVENTION

The solving of these problems to a large degree is accomplished. In accordance with this invention also, by passing a measuring gas through the investigated region or stratification and locating selected measuring positions, so that by comparison of the measured data from the network of measuring locations a sort of X-ray picture is made, the deterioration of the (dam) structure and the porosity of the investigated objects and disturbances, such as fissures or cavities, may be satisfactorily understood. Furthermore, the method is inexpensive and besides does not have damaging consequences on the investigated place with the use of $CO_2$ as the measuring gas.

In the claims the particular examples of the method for various applications is characterized. Also, embodiments of the apparatus afforded by this invention which is especially advantageous is claimed.

BRIEF DESCRIPTION OF THE DRAWINGS

Both the method and the apparatus will be understood better from the following preferred embodiments set forth in the drawings.

The drawing shows in:

FIGS. 1, 1A, 2, 2A and 2B a first embodiment of an application of the invention to the investigation of a dam, FIG. 1 being a diagrammatic perspective sketch of the dry face of a dam;

FIG. 1A being a schematic sketch of an injection tube placed in the dam;

FIG. 2 being a perspective sketch of the water side of the dam;

FIG. 2A being a schematic pipe and injection tube array; and

FIG. 2B being an end view of the dam; and in

FIGS. 3 and 3A a second embodiment for the investigation of a dam foundation and the stratification underneath a dam, and FIG. 4 an embodiment of the location of an underground cavity or the ascertainment of tectonic dislocations.

PREFERRED EMBODIMENT OF THE INVENTION

Figure 3:
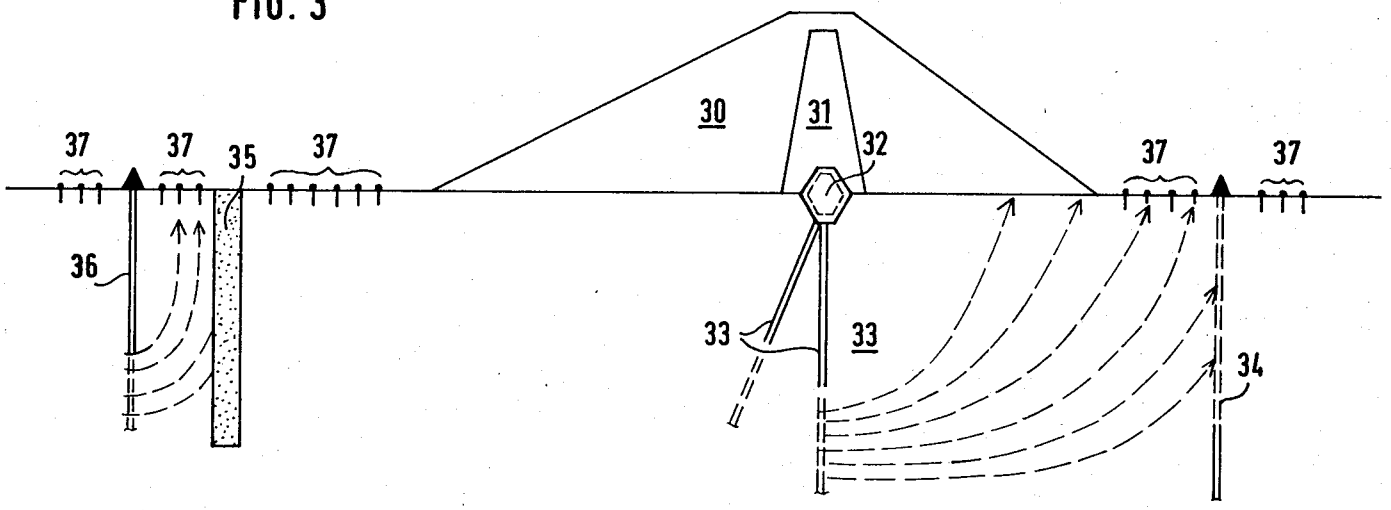

In accordance with the first embodiment of the invention, which follows, the control of the porosity and foundation condition of a dam is explained. Therefore the description of the measurement and control apparatus according to FIGS. 1 and 2 will explain the general background and the method.

As previously mentioned, it is recognized from the testing of the horizontal spreading of earth gas in dug out conducting channels that the length of the spread out zone from the channel axis depends upon the porosity and dampness of the soil or earth structure. Furthermore, it is known from the pressurization of the gas for the purpose of gassing plants, that also the surface directed gas under pressure depends upon the thickness and dampness of the soil. Now by this invention is created the control of the porosity and the foundation strength of an irrigating or constructed earth and stone dam, whereby the dam can be treated for obstructions, for streams and canals, on all sides, and for embankment to protect against high water and storm tides.

The thickness of a dam against ground water leakage is a decided security measure with reference to leakage and unsound foundations, whereas high porosity to water predominately prevails during structural change and ripping or cracking conditions, which in the last stages can cause a dam break. Accordingly structural variations and deformations happen, especially many stratifications in the vicinity of higher earth dams, where non uniform ground structure patterns permit variable formations to come between the separate earth layers. Cracked structure follows particularly parallel to the dam axis and skewed or diagonal thereto. When the skewed or diagonal running fissure system comes closest to perpendicular to the dam body, a special importance is attached, since the way for a concentrated porosity is cultivated leading to erosion of the covering layers and the thickness base for the dam. Especially vital is the formation of horizontal fissures in the thickness core. These kinds of fissures are not easily recognized from the top layer and are the main reason for intensive porosity leading to dam breaks.

The mentioned danger of the appearance of deformations and fissure structure requires careful control of the dam. In order to inspect the dam different methods are used during the building phase and afterward. Among the known methods number the measurement of the vertical and horizontal changes in the dam interior by means of inclination meters, strain gages, piezo meters and pressure transducers. All the heretofore known methods and technical structure measurements thus have disadvantages such that neither financial spending nor the site bordering dam elements can correct.

Contrariwise, now by means of this invention a widely usable, sure and low cost control method is provided. The method provides supply and measurement of the flow paths of injected gas. It is known that gas diffuses through the tiniest pores and channels when put under pressure. Now if a dam, normally possessing as a result of technical building material strengthening or special technical site precautions simply a very small horizontal porosity for liquids and gas, has horizontally running fissures of the above described type, this increases the danger to the dam body and probably exhibits a substantially high gas throughput. Now according to the invention, measuring gas under the smallest necessary pressure is introduced in the dam permitting a horizontally directed flow at which a corresponding portion can be captured and measured on the other side of the dam. The concentration of the gas there coming through and the time that it takes to flow through the dam cross section is determined as a measure of the porosity of the dam. With equipment at a number of measuring locations a "picture" of the inner structure of the dam is developed, giving the exact information about disturbances, for example horizontal fissures. It is thereby also possible to determine more or less natural underground fissures running substantially perpendicular to the dam axis, so that something about disturbed settlement rates, slope interruptions, shearing and broken ground formations can be established. In one such case following, namely the injection gas simply passed into a horizontally directed passageway and then going over a perpendicular directed stratification can be ascertained by means of measurement of the gas on the other side of the dam.

The method of the invention also considers that input gas under pressure in the dam body spreads out along the normal or damaged sediment structure and in a normal case follows the course of a similar electric potential current path. With a considerable thickness of the dam length only a small part of the injected gas arrives at the opposite dam site side from injection after an extended delay of a large number of hours. With existing horizontal porosity in the ground from fissure formations the amount of the gas arriving at the other side is increased by corresponding reduction at the diffusion site. These current paths of the injected gas change in the presence of fissures running more or less vertical to the height of the dam or parallel, diagonal or perpendicular to the dam axis. The spreading of the gas follows then preferably these fissures, so that a larger portion of the gas moves away from the route to the crown of the dam. Thus, the concentration and the time for the arriving gas provides a direct measure of the place, the size and the porosity of the defects. By using the injection gas, particularly $CO_2$, which has the advantage of being easily available, the ease of transport and measurement follows. The danger that $CO_2$ reacts with the ground water to form a compound ($H_2CO_3$) exists but accordingly the solubility of lime and chalky dam materials expected is negligible as a result of a small dwelling time of the gas in the dam body and a small tendency of the $CO_2$ to form carbonic acid with water. Furthermore, if such other gases, for example methane, propane, $SO_4$ or active gases are introduced, it is presumed that because of the low reaction capability or solubility with water and dam materials that unobjectionable measurements may be demonstrated.

Equipment for the control of a dam in accordance with this process is shown in FIGS. 1 and 2. Thus, in FIG. 1 dam 10 is shown, which on one side 10*a* generally the so called air side (land side), is provided gas injection means. This gas injection means in the shown embodiment consists of a first unit 11 and a second unit 12. The unit 11 has a substantially rectangular pipe frame consisting of two vertical pipes 13 and four horizontal pipes 14. The vertical pipes 13 are closed at their ends. A gas coupler is shown at 13*a*. The horizontal pipes 14 running into the pipes 13, consisting of the inner framework in conjunction with uniformly spaced inlets, from which plastic pipes 15 with shut off valves 16 extend as connected by the watertight packing cone 17*a* on the injection pipe 17, as best seen from FIG. 1A. The further unit 12 is constructed similarly to unit 11.

Other (not shown) inlets can be provided with similar functions which can be located with respect to unit 11 to whichever corner of the upper side of the vertical pipes 13 of the unit 11 that seems desirable. In this manner apparatus is provided of the nature of a (gas) outlet channel. Understandably this "outlet channel" can consist of more such units in accordance with the height of the dam.

In accordance with a practical example of the apparatus 11, sixteen injection pipes 17 of a light metal with a length of 0.5 meters are separated the same distances, along the four horizontal pipes 14. The apparatus 11 thereby has a length and a height of approximately three meters. Through a further unit, the height can be extended to about six meters. It is further to be recognized that it is also possible to provide a separate stiff frame, which if necessary telescopes, from which frame one or more units 11 for example, twelve are rotatably arranged, The use of a special frame provides the advantage that cross-pieces can be used together as ladders for the service people.

In operation of the apparatus, the injection tube 17 is placed in the dam by insertion into boreholes receiving the cone 17*a* as a watertight coupling. Afterwards with a small pressure from $CO_2$ or some other measurable gas inserted in apparatus 11 and 12, such as through coupling of the gas source 18 (FIG. 2B) onto the gas input 13*a*, and respectively by a similar input to the apparatus 12. A tank with fluid $CO_2$ and evaporator can be used as the measured gas source, or a carbonic acid pressurized flask or other pressurized flask or container with methane, propane, or sulfur dioxide. For a special uniform feed of the gas to the injection pipe 17, it can be advantageous to locate a gas inlet rather than at the shown position 13*a*, on the underside of the vertical pipes 13.

FIG. 2 shows the opposite side 10*b* of the dam 10, generally the water side of the dam, on which the measuring equipment is located. The measuring equipment consists of numerous measuring probes 20, wherein each in accordance with FIG. 2A is connected by tubing 21 and a magnetic valve 22 to a pipe 23, which is attached as desired to a vacuum pump via 24 or a gas measuring instrument via 25, for example for $CO_2$. Each sensing probe 20, as FIG. 2A shows, is a tubing which in its inserted area is perforated, and in an area rearward thereto carries a watertight fastener cone 20*a*. In this embodiment the sensing probe 20 has a length of about 20 cm and perhaps ten probes 20 forming a measuring unit, whereas single tubes 21 are fastened together in a bundle of tubes. The perforated holes of the probes 20 are preferably arranged to spiral about the tubing.

Thereafter the probes 20 are inserted or embedded into the deck or insulating layer of the dam 10 by inserting into boreholes. The distribution of the probes are accordingly preferably uniform. The number of the sensing probes 20 to be used depends upon the actual need, although understandably the "thicker" the resulting structure, the better it is to put the probes closer together. Regarding the insertion of the sensing probes 20, the entire piping system can be used for entry with a gas stream and removal with a vacuum. Thereby the entry of gas in the probes and the further transport of measuring gases into the measuring apparatus 25 is made simple. After starting the injection phase by means of the injection apparatus of FIG. 1, the gas analysis in each of the probes is interrupted, that is to say, the single magnetic valve 22 will open and close the line. The meter of the analysis equipment is consequentially digital. The measuring apparatus is supplied with a heavy membrane pump (not illustrated), which is powerful enough that it can transport gas through the tubes between the probes 20 and the measuring instrument 25. The measurement of the concentration of $CO_2$, methane and propane by the measuring apparatus is accomplished by the principle of heat tone. Such equipment is available in the trade. However, another measuring system is used for sulfur dioxide. The outgoing signal of the measuring equipment 25 will operate a meter pointer and/or a printout instrument, especially one with a graphical display supplying thereby a sort of X-ray picture that can be preserved for simple evaluation.

If the length of measurement is more than 10 meters, then the single pipe length can be increased up to about seven fold. Thereby, altogether 70 measuring pipes may be bundled together at a lower portion. With a pump and analyzing period each of 20 seconds duration, altogether about 24 minutes is necessary to go through the complete scanning of the pipe bundle. If the measuring length of a dam exceeds 70 meters, then a further measuring unit 70 meters long can be used as a second measuring system. With a gas injection width of three meters from the injection site, the measuring sound system on the receiving side against the scattering effect face of the gas need be about six meters wide. The measurement of a six meter wide slice is also simplified by three pipe systems which as above stated can have up to 70 meters total length. Each piping system has a measuring apparatus and an operating person.

For smaller dams, the number of measuring positions is decreased. By connecting together the three piping systems for the six meter wide measuring front, a single operator person and a single measuring apparatus will work. In the case such smaller dams follow the longer side of the injections, the measuring system is suitably fastened by horizontal lying light metal bands.

In a second embodiment of the invention, illustrated in FIGS. 3 and 3A, neither the dam body itself nor the geological terrain are checked. However here the inquiry is made to the porosity through the dam, for example, the longitudinal porosity of the foundation support or cracked rocks, which could cause an undermining of the dam body and a water leaking ground fracture. In this way the inquiry into dam defects can be undertaken naturally and fractures can be handled in earth dams as well as those of cement or other strengthening materials.

In FIG. 3 a dam is shown at 30, with a strengthening body 31 with a control trench 32 parallel to the longitudinal axis of the dam. From this control trench 32 the injection bores 33 are bored into the dam foundation terrain either vertically or at a slant in accordance with this invention. The bore holes 33 can be either partly or completely piped, whereby in the latter case, the unpiped borehole portions serve for the entrance of the injection gas into the various sites. Furthermore, at least one fixed measuring bore 34 is provided for the admittance of the injected gas, which preferably runs vertically and in its upper region is a borehole. The injection bores 33 and measuring bore 34 serve in the following described manner to test the dam foundation. Furthermore in FIG. 3, an obstruction layer 35 such as a cement insert is placed on the water side of the dam 30 and serves to protect against under washing. For testing this obstruction layer 35, an injection bore 36, partly piped, generates measuring sounds 37 at the ground surface. In accordance with FIG. 3A one such sound measuring embodiment 37 has a fastening cone 37*a* coupled by a tubing 38 with a stop control valve 39 to a not illustrated measuring instrument. The sound measurer 37 is directed into a prepared bore 40.

The practical accomplishment of the testing of the dam foundation follows also with the help of one or more injection bores 33 or 36, which are driven slanted or perpendicular to a depth up to 100 meters in the geological underground. These bores 33 can be drilled after the end of construction of the control trench 32 for an earth or stone dam 30. In the piped or unpiped portions of boreholes 33 an inserted gas under pressure such as $CO_2$ or methane or propane or sulfur dioxide, according to the porosity of the geological stratum spreads out underground more or less quickly and widely, in the manner of the flow of ground water. This spreading of the gas in the depths will be comprehended by means of measuring bores 34, whose depth relative to injection bores 33 is known. This spreading of injected gas follows not simply horizontally but rather in a more important greater extent in the direction toward the earth's surface. By means of supplying additional surface measuring bores 37 about 0.8 meter deep, it is possible to understand by surface measurements the paths and spreading of the gas underground. Thus the injected gas streams into the unpiped lower portions of the measuring bores, from which it is evacuated. That gas will pass through the piped portion and for measurement passes over the shortest possible plastic tubing to a measuring instrument, somewhat in the manner set forth in the first described example. From the soil on hand, for example, the natural gas will hardly influence the measurements, because the concentration of the injected gas is essentially much larger. Preferably also further surface positioned sound measurers 37 are provided.

In case an obstruction layer 35 of cement or strengthening material hinders spreading of gas from an injection bore 36 from a further horizontally located position and forces gas at a shorter time into a shorter path directed toward the earth's surface, then this gas can be captured and measured. Only by interruptions or insufficient strength of the obstruction layer 35, would a portion of the gas pass through the obstruction layer 35 over a longer pathway. An interruption of the obstruction layer 35 is also characterized in that the measuring instruments 37 essentially have less gas than for an unbroken stony region of the obstruction layer 35. Understandably it is also possible to provide further surface measuring instrumentation behind the blocking layer 35 and dam 30 on the air side to measure the gas flow through the blocking layer 35.

Figure 4:
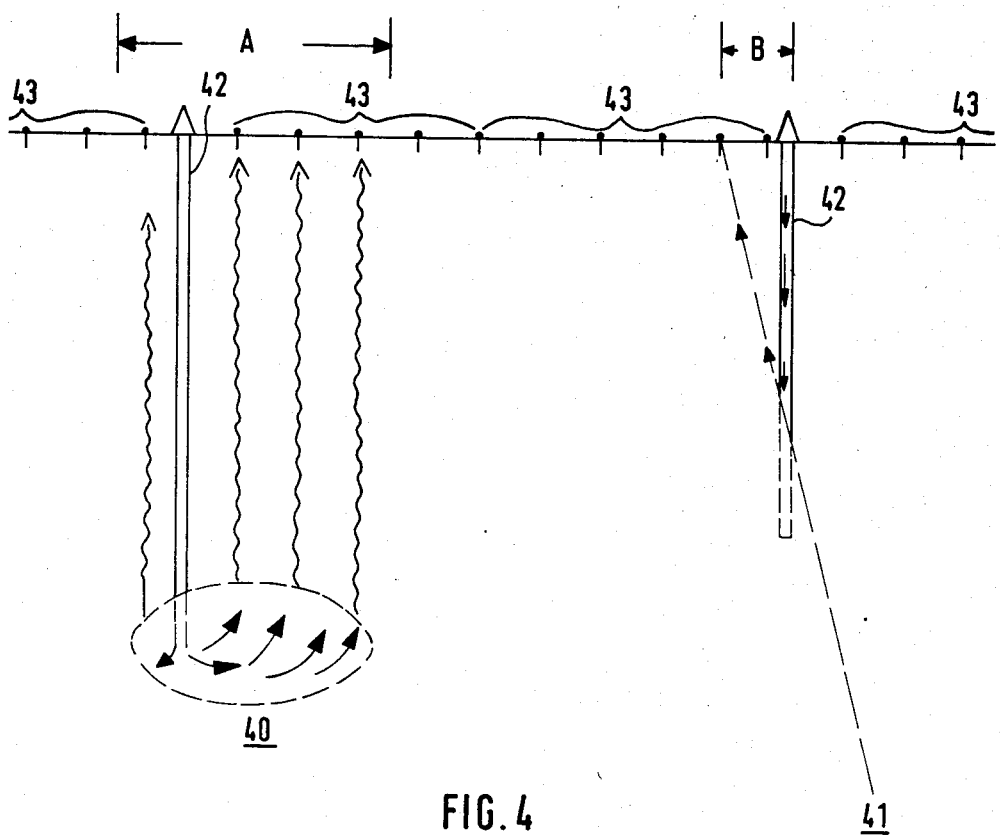

A third embodiment of the invention, permitting understanding and location of below ground cavities and underground deformities follows as made more clear from FIG. 4. An underground cavity 40 is shown in FIG. 4, with 41 being an underground deformity.

From the ground surface an injection bore 42 is vertically extended and on the earth's surface are many surface mounted sound measurement instruments 43.

Underground cavities are formed by geological processes or by mining work. The geologically formed cavities are crevices and caverns. Mining cavities are wells, bores, shafts, tunnels and dispersed tunnels for removal of materials. Also other cavities in the ground are made for military or civilian defense. The place and shape of these cavities are not in all cases known. That is important especially for old mine sites which do not display the boundaries with the same precisions that now must be defined. The nature of the underlying strata is seldom known for sure to determine whether to begin construction.

This invention can correct that by locating such underground cavities, unknown crevices and deformations. Under normal mechanical mining conditions a conical sink hole network is constructed over the underground cavity formed by directed and spreading branches. This structure runs in the direction of the cavity and causes a large porosity between the underground cavity and the ground surface. This structure, from along which gas flowing from the joints can spread, will now be used in accordance with the invention. For this purpose $CO_2$ or another similar gas is injected in the injection bore 42 into the cavity 40. This pressurized and in part water soluble gas spreads in cavity 40, thereby permitting diffusion through the adjacent strata thereabove, to be measured by the measuring stations 43 on the surface. The gas filled cavity 40 so to say by help of the gas is transformed to the surface. In other words, the sound measuring instruments 43 in zone A of FIG. 4 will receive gas whereas the other instruments 43 will remain gas free. The arrangement of the surface instruments 43 may be as in 37 of FIG. 3A.

The practical way for the location of an underground cavity 40 starts from the prior knowledge of the natural spreading of gas through the soil above a probable cavity. This together with the natural gas concentration escaping from seams in the rocks covering the cavity provides a location for one or more injection bores 42. The second step toward the location of an underground cavity 40 then proceeds with the help of one or more bores. The ground position of the bore 42 is possibly that of the cavity 40 itself or possibly of a particular rock which is located over a seam from the cavity 40. The bore 42 is therefore provisionally bored over the porous zone. From the mouth of the bore, the gas is pressurized in the cavity 40. During and after the pressurization the soil gas measurement will increase in positions where the gas porosity is higher.

There is one special advantage of the process of the invention; especially when $CO_2$ is chosen as the forced in gas, in that no remaining and damaging effect to the stone, soil and (dam) structure results, since the greatest portion of the injected gases quickly filter to the earth's surface and only are a very small part of the gas, perhaps 0.1% remained in the ground water as carbonic acid. Carbon dioxide has another advantage in that it can quickly and exactly be quantitatively analyzed with simple measuring apparatus. Thus, the method can be used to locate cavities lying as deep as 200 meters. Also the other mentioned gases have little damaging effect because of the high degree of dilution in the earth and stone strata.

The before described method can also recognize tectonic underground fissures. If the normal stratum of a rock formation is disturbed by being broken off and shoved up to make a fault, such massive stratification can behave somewhat like the construction of a dam to dam up the water at a stop due to the strength of the movement process forming the tectonic fault. Otherwise such a break also can be a reason for uncontrolled ground water streams.

Regarding now the understanding and location of such a break 41 (FIG. 4), in accordance with the invention, by means of the injection bore 42, which can be from a few meters to over 100 meters deep, measuring gas under pressure is entered, which in the porous stratum under the earth spreads out laterally when this gas arrives in the vicinity of an elongated tectonic deposit 41. Then the gas travels through the deposit stratum 41 to the earth's surface and can be determined through the surface mounted measuring sounders 43. The tectonic deposit 41 serves therefore as a kind of drain for the released gas. The measurement of the gas follows in the same way as in the locating of a cavity. In this case the surface sound measuring instruments placed in the field B receive gas, and the measuring instruments outside this field remain essentially gas free.

Other variations of this method in addition to the inquiry into tectonic breaks and fissure systems in regions for locating dams and water level controls, also include determining the porosity of stores of secondary gas deep underground, natural deposits of oil and gas, which would be destroyed by fracturing disturbances, slopes, deposits and conduits, Furthermore this invention employs the construction of dams with the locally available materials, sometimes with cement work either reinforced with iron or not, with knowledge of the deteriorating zones or fissure systems, by the release of gas in a suitable location such as from control bores and the like. Thus simple reading of gas measurements is assured by gases which qualify as measuring gases, particularly radioactive gases, since the smallest exact measurements can be made with corresponding detectors. preferably a gas is chosen with little activity for safety purposes and a short half life. Furthermore one can with small porosity choose a lighter gas, for example helium, or like gases with greater penetration capability.

Understandably all variations of the invention cannot be set forth here, so therefore the determination of gas porosity of the earth, such as stony regions for the presence of interruptions is in the broadest sense covered.

I claim:

1. The non-destructive method of investigating the structure, dampness, and porosity of soil and stony bodies over substantially large areas such as that effecting the percolation of water in areas about dams, comprising the steps of, introducing a measuring gas under slight pressurization at an injection site in the locality being investigated to penetrate the soil and flow outwardly from the injection site as a function of the porosity and dampness of the soil, recapturing and measuring the gas at several measuring sites remote from the injection site after penetration into said bodies, and measuring the time of penetration through the bodies under investigation from the injection site to the measuring site and the concentration of the resulting gas to establish the dampness and porosity of the bodies.

2. The method of claim 1 wherein the bodies are earth and stone dams, for determining and locating fissures, further including the steps of, introducing the measuring gas at the air side of a dam at several places in the dam body, and measuring the penetration of gas through the dam body by sensing that gas passing through the dam.

3. The method of claim 1 wherein the bodies are earth and stone dams comprising the further steps of providing a set of control bores at the dam site, introducing a measuring gas into the control bores at several places along the body of the dam, and collecting for measurement gas escaping from the control bores through porous materials at the dam site.

4. The method of claim 1 for locating and determining the dimensions of underground irregularities comprising the additional steps of, drilling a bore hole downwardly into the earth over a suspected irregularity site, introducing the measuring gas into the bore hole, and locating a network of measuring probes at the earth's surface to analyze escaping measuring gas to thereby produce a pattern related to the underground irregularity location and dimensions.

5. The method of claim 4 including the step of introducing a gas into said injection site by means which prevents water from entering the injection site.

6. The method of claim 1 including the step of introducing carbon dioxide gas under pressure into the injection site.

* * * * *